United States Patent [19]

Nees

[11] Patent Number: 4,648,863

[45] Date of Patent: Mar. 10, 1987

[54] APPARATUS FOR THE PURE PREPARATION OF PARTICLES, BIOLOGICAL CELL SYSTEMS AND COLLOIDS

[75] Inventor: Stephan Nees, Munich, Fed. Rep. of Germany

[73] Assignee: Edmund Bühler, Tübingen-Weilheim, Fed. Rep. of Germany; a part interest

[21] Appl. No.: 698,573

[22] Filed: Feb. 6, 1985

[30] Foreign Application Priority Data

Feb. 7, 1984 [DE] Fed. Rep. of Germany ..... 3404236

[51] Int. Cl.[4] ..... B04B 5/02

[52] U.S. Cl. ..... 494/17; 422/72; 436/45; 494/13

[58] Field of Search ..... 494/16, 17, 22, 18, 494/21, 23, 17, 38, 13, 14, 60, 61; 422/72, 100, 102, 104, 64; 436/45

[56] References Cited

U.S. PATENT DOCUMENTS 2,616,619 11/1952 Leod ..... 494/17
3,452,924 7/1969 Schlutz ..... 494/17
3,679,367 7/1972 Negersmith ..... 422/72
4,456,581 6/1984 Edelmann ..... 494/17

*Primary Examiner*—Robert W. Jenkins
*Attorney, Agent, or Firm*—Peter K. Kontler

[57] ABSTRACT

A process for the pure preparation of particles, biological cell systems, colloids and the like, in which liquid density gradients are produced in a rotating centrifuge container (1), and in which the particles and the like are introduced into the centrifuge container (1), individual bands being produced in such a manner that the bands containing the heavier particles are more remote from the axis of rotation than are the bands containing the lighter particles. The density gradients are constructed by the introduction of fractions of different density (a–f) via a cannula (18) which extends into the centrifuge container (1) to just before a tip (19) of the latter, the lightest fraction (a) being introduced first and the heaviest fraction (f) being introduced last. After the particles and the like have been introduced and the individual bands (a' to f') have been produced, the individual bands (a' to f') are removed via the cannula (18) by pumping out from the centrifuge container (1) which has been rotated at a preset separating speed of rotation.

15 Claims, 5 Drawing Figures

APPARATUS FOR THE PURE PREPARATION OF PARTICLES, BIOLOGICAL CELL SYSTEMS AND COLLOIDS

BACKGROUND OF THE INVENTION

The present invention relates to an apparatus and to a process for the pure preparation of particles, biological all systems, colloids and the like.

It is known that particles, molecules, etc. of different densities can be separated from one another by centrifugation in liquid density gradients. For example, density gradients of this type can be obtained by rotating, in a horizontal plane, centrifuge tubes which contain liquid layers which become stepwise and continuously more dense towards their bases. If particles, molecules, biological cells, etc. are introduced centrifugally into this gravity field, then, after the sedimentation equilibrium has been reached, individual bands result in the centrifuge tube, the bands containing the heavier particles, as well as the mroe dense regions of the density gradient, being more remote from the centre of rotation than the bands containing the lighter particles. While in centrifugation arrangements of this type the separation into individual bands succeeds well with existing centrifuges, problems arise on removal of each band in the pure form. It is known that this is because the individual bands are obtained by pipetting each of them out of the centrifuge tube which has been removed from the swing-out rotor of the arrangement. However, contamination of the individual bands due to turbulence, mixing and diffusion is unavoidable during the pipetting process.

In other known processes, the gradient with the separated bands present in the centrifuge tube is pushed out by pumping in an extremely dense liquid from the lowest point in the tube to the upper rim of the tube, and is led off from there and fractionated by means of a pressed-on funnel with tubing line. However, a process of this type is complicated and requires a costly additional device. Moreover, even in this case it is not possible completely to avoid mixing of individual bands and diffusion processes.

OBJECTS AND SUMMARY OF THE INVENTION

An object of the present invention is to improve the rotor and the process of the type mentioned above in such a way that it is possible even during centrifugation to obtain, sharply and easily, the bands separated by the centrifugation.

This object is achieved with an apparatus characterised by and with a process for the pure preparation of particles, biological cell systems and colloids as defined in the appended claims.

An important advantage of the present invention is the possibility of obtaining, even during the centrifugation process, the individual bands which have been produced, without loss of the theoretical and practically attained sharpness of separation. By this means it is possible completely to avoid undesired mixing or diffusion processes.

The horizontal rotor according to the invention is advantageously such that, in contrast to known rotors, it can easily be disassembled and sterilised or autoclaved. The horizontal rotor according to the invention is advantageously constructed is such a way that it can be autoclaved in the assembled state and thus also be used for separating biological cells (blood, tissue culture, etc). When used for purification in cell biology, the autoclaving of the rotor and its enclosed nature also prevent contamination of the resulting cell and organelle fractions when the bands are being obtained.

The horizontal rotor according to the invention is advantageously such that it is possible to use commercially available centrifuge tubes.

Due to the fact that it is possible straight-forwardly to separate animal, plant and human cell types using the horizontal rotor according to the invention, there arise increased opportunities of being able to culture them "in vitro" in the tissue laboratory in a more defined manner than hitherto. This also results in, for example, new starting points for the specific testing of medicaments. Thus, it is also possible in an advantageous manner to restrict elaborate and undesired animal experiments more than has hitherto been possible.

The invention will be explained in detail with reference to the drawing:

DESCRIPTION OF THE PREFERRED EMBODIMENTS

Figure 1:
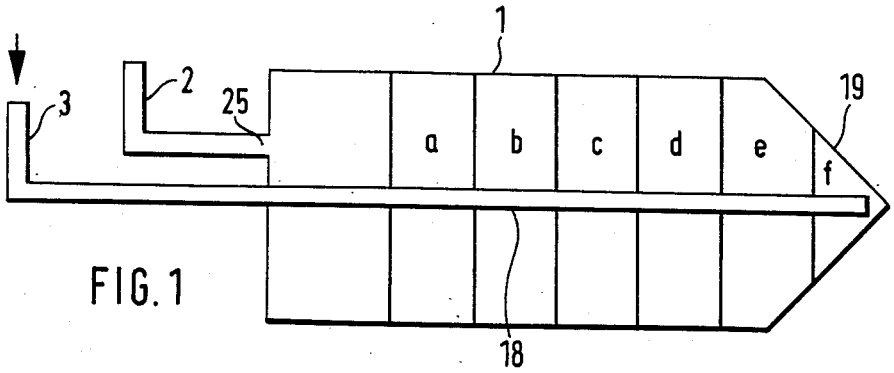
FIGS. 1 to 3 are diagrammatic representations showing the mode of operation of the horizontal rotor according to the invention.

A centrifuge container 1, which is, for example, a centrifuge tube, is first brought, by a horizontal rotor which will be explained in detail below, to a speed of rotation for introduction. This speed of rotation for introduction is, for example, 100–200 rotations per minute. When the speed of rotation for introduction is reached, the gradient is constructed via the cannula tube 3 and the cannula 18 which runs along the long axis of the centrifuge tube 1. This is carried out by introducing the lightest fraction a first and the heaviest fraction f last. The centrifuge tube 1 has a cylindrical shape and a base which is constructed to form a tip 19. The end of the cannula 18 which is located in the centrifuge tube 1 terminates just before the tip 19.

After the density gradient zones a to f have been introduced, the rotor speed is increased to, for example, 1500 rotations per minute in order thus to achieve greater acceleration and thus exertion of a greater force, in order to sharpen the zones of transition between the fractions (FIG. 1).

Figure 2:
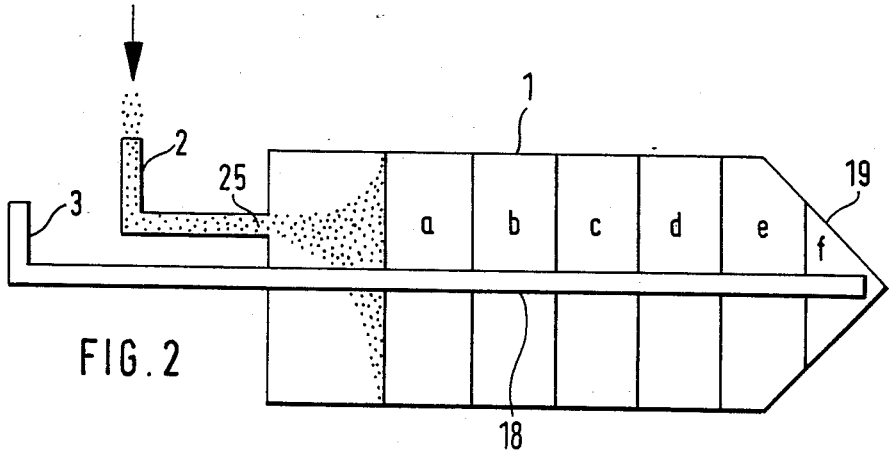

The sample which is to be separated is now applied through the cannula tube 2 and the passage 25 and, depending on the separation problem, is centrifuged at 1200–2000 rotations per minute for 10–60 minutes (FIG. 2).

Figure 3:
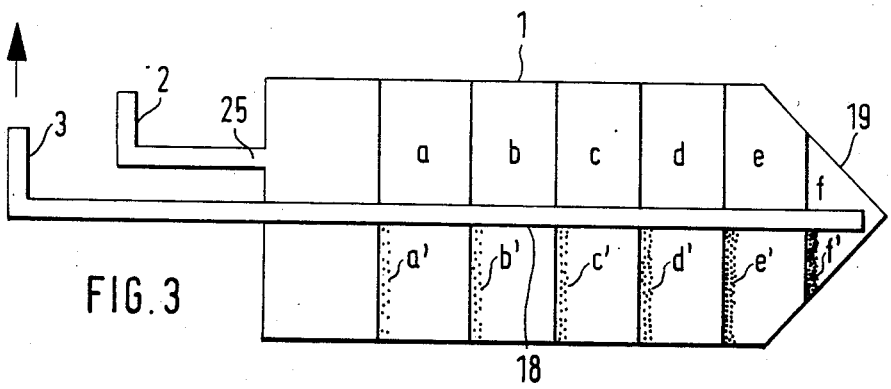

Then the speed of the rotor is reduced to the separating speed of rotation of, for example, 250 rotations per minute, and the separated zones a to f, with the embedded sample bands a' to f', are pumped out via the cannula tube 3 (FIG. 3).

The horizontal rotor according to the invention for carrying out the process described above is represented in FIG. 4. Details which have already been described in connection with FIGS. 1 to 3 have been given the corresponding reference symbols. The horizontal rotor is located in a housing which comprises a base flange 6, which is preferably arranged horizontally, a housing ring 21, which extends preferably at right angles to the base flange 6, and a lid 10. The base flange 6 and the housing ring 21 are advantageously composed of aluminium. The side of the housing ring 21 facing the base flange 6 is, for example, screwed onto the base flange 6 (not represented). The lid 10, which is preferably composed of a transparent material, such as, for example, perspex, is advantageously inserted into an annular recess 23 provided on the interior periphery of the housing ring 21. It is possible to run a helical tube 20 around the housing ring 21, through which the housing can be cooled or heated, depending on the medium flowing through the tube.

Figure 4:
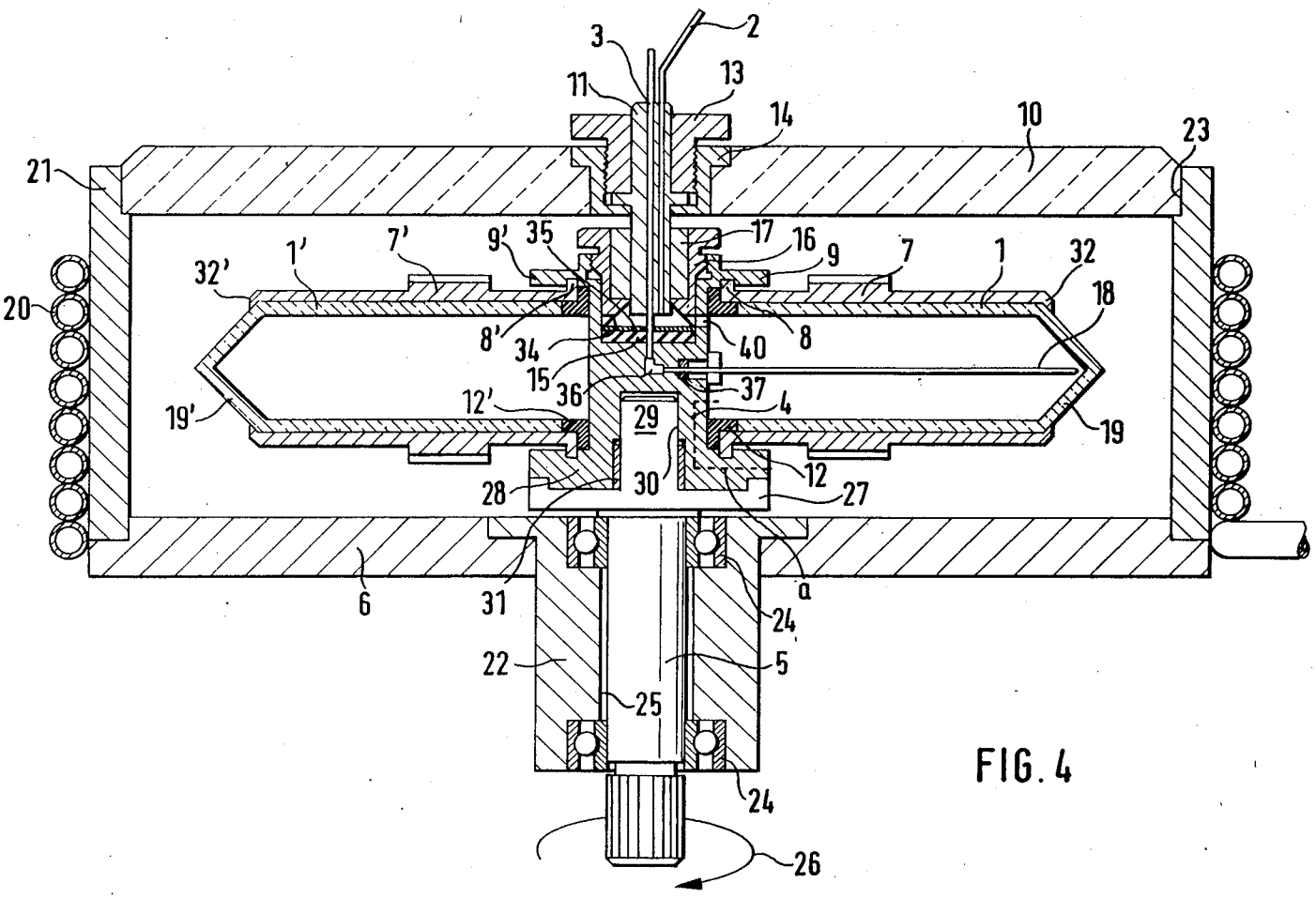
FIG. 4 shows the construction of the horizontal rotor according to the invention.

A bush 22 is located in the centre of the base flange 6 and is preferably likewise composed of aluminium and is, for example, screwed into a hole drilled in the centre of the base flange 6. The bush 22 has an interior drilled hole 25 through which runs the drive shaft 5. The drive shaft 5 is rotatably mounted in the bush 22 by means of bearings. For example, two ball bearings 24, which are spaced from one another, are provided in the bush 22, as is shown in FIG. 4. The drive shaft 5 is set in rotation by a motor which is not shown (arrow 26).

A basic rotor body 4 is fixed, in a rotation-resistant and detachable manner, to the end of the drive shaft 5 projecting into the housing. The end of the drive shaft 5 projecting into the housing preferably has a circular horizontal flange 27 which runs radially outwards and on which is supported a likewise circular flange 28 of the basic rotor body 4. The terminal zone 29 of the drive shaft 5 which projects beyond the flange 27 of the drive shaft 5 extends into a central centering drilled hole 30 of the basic rotor body 4. When the basic rotor body 4 is placed on the flange 27 and the terminal zone 29 of the drive shaft 5, a rotation-resistant connection between the basic rotor body 4 and the drive shaft 5 is attained preferably by splines 31 or the like. The basic rotor body is preferably composed of stainless steel or a steel resistant to rust and corrosion.

Centrifuge tubes 1, 1' are fixed to opposite sides of the basic rotor body 4 by means of holding parts 7, 7', which are preferably composed of steel, in such a manner that the long axes of the centrifuge tubes 1, 1', which run coaxially with respect to one another, are aligned horizontally and are at right angles to the common long axis of the basic rotor body 4 and the drive shaft 5. The basic rotor body 4 has, on its opposite sides, preferably circular projections or centering support rings 9, 9' in which are fixed the terminal zones of the holding parts 7, 7' which face the basic rotor body 4. These terminal zones of the holding parts 7, 7' are preferably fixed by flange parts 8, 8' which run radially outwards and are located at the ends of the holding parts 7, 7' facing the basic rotor body 4, engaging in grooves which are provided in each of the interior walls of the circular projections 9, 9'. These grooves the flange parts 8, 8' form bayonet mounts. A circular sealing disc 12, 12', which is preferably a silicone seal, is located in each of the circular projections 9. 9' in such a manner that the ends, which face the basic rotor body 4, of the centrifuge tubes 1, 1' which are contained in the holding parts 7, 7' are pressed solidly and tightly against the seal 12, 12' when the holding parts 7, 7' are fixed to the basic rotor body 4 by the bayonet mounts already described. The pressure in the longitudinal direction of the centrifuge tubes 1, 1', which is necessary for this, is applied by the end surfaces 32 and 32' which face away from the basic rotor body 4 and have drilled holes through which the tips 19, 19' of the centrifuge tubes 1, 1' partially project and abut the edges around the drilled holes in such a manner that the axial length between the points of engagement and the bases of the projections 9, 9' is smaller in each case than the axial length of the unstressed seals 12, 12' plus the distance between the end, which faces the basic rotor body 4 of the centrifuge tube 1, 1', and the point of engagement.

As can be seen in FIG. 4, the cannula 18, which has already been mentioned in connection with FIGS. 1 to 3, is provided in only one centrifuge tube 1. The other centrifuge tube 1' and the corresponding parts for its fixing merely serve to achieve a symmetrical distribution of weight (equalisation of mass) for the centrifugation process. For this purpose, the quantity of liquid introduced into centrifuge tube 1' corresponds to the quantity of the gradient plus the introduced sample contained in centrifuge tube 1. In place of the other centrifuge tube 1', it is also possible to provide another suitable arrangement by which a symmetrical distribution of weight is brought about.

The basic rotor body 4 has a hole drilled in the centre of its end which faces the drive shaft 5, into which hole a pressure screw 16 can be screwed. The pressure screw 16 has, in its terminal zone facing the basic rotor body 4, a recess 34 which is preferably conical and is connected via a drilled hole 40 to the interior of the centrifuge tube 1. This entails this drilled hole 40 running through the edge zone of the recess 34 of the pressure screw 16 and the basic rotor body 4. On the base of the drilled hole present in the basic rotor body 4, into which the pressure screw can be screwed, is located a seal 15 which is preferably composed of silicone and is pressed hard on the base of the drilled hole by the edge zones around the recess 34 of the pressure screw 16 which has been screwed in. In order to bring about particularly good contact, a pressure disc 35, which has a central hole whose function will be explained in detail below, is located on the side of the silicone seal 15 which faces toward the pressure screw 16.

A sleeve 17, which is preferably composed of an autoclavable material, such as, for example, PTFE material, is fitted in the centre of the pressure screw 16 and has a central drilled hole in which is rotatably mounted a guide pin 11. A first cannula tube 3, which runs along the long axis of the guide pin 11, and a second cannula tube 2, which is displaced eccentrically with respect to the first cannula tube 3, are rigidly bonded, preferably welded, inside the guide pin 11, which is preferably composed of steel. The end of the first cannula tube 3 which faces the basic rotor body 4 projects beyond the guide pin 11 and extends through the central hole in the pressure screw 35, which has already been mentioned, and the seal 15 into a passage 36 provided in the basic rotor body 4, into which passage the end of the cannula 18 facing the basic rotor body 4 also opens. A seal 37 ensures that a medium introduced into the cannula tube 3 passes completely from the passage 36 into the cannula 18 and cannot flow past the side of the cannula 18. The seal 15 sealingly abuts the outer periphery of the first cannula tube 1.

The second cannula tube 2 opens into the recess 34 which is connected via the drilled hole 40 to the interior of the centrifuge tube 1.

A locking socket 14 through which the guide pin 11 can be passed is provided in the centre of the lid 10 of the housing. The terminal zone of the guide pin 11 which faces the lid 10 is also passed through a securing screw 13 which can be screwed into a hole drilled into the locking socket 14 in order to fix, secure against rotation, the guide pin 11 to the lid 10.

In the embodiment represented in FIG. 4, the cannula 18 runs along the long axis of the centrifuge tube 1 to just before the tip 19. However, it is also conceivable to arrange this cannula in such a way that it is displced with repect to the long axis of the centrifuge tube 1.

The mode of operation of the horizontal rotor according to the invention will be explained in detail below. The description of operation is based on the premise that initially the basic rotor body 4, the centrifuge tubes 1, 1', the holding parts 7, 7', the pressure screw 16, the lid 10, the guide pin 11 and the securing screw 13 are separated from one another. First, the two centrifuge tubes 1, 1' are fixed to the basic rotor body 4 by engaging the bayonet mounts between the basic rotor body 4 and the holding parts 7, 7'. This entails that those ends of the centrifuge tubes 1, 1' which face the basic rotor body 4 are pressed hard against the silicone seals 12, 12' which have been put in place. The cannula 18, which is fixed to the basic rotor body 4, then runs to just before the tip 19 of the centrifuge tube 1, as is represented in FIG. 4. After the silicone seal 15 and the pressure disc 35 have been put in place in the appropirate drilled hole in the basic rotor body 4, the pressure screw 16 is screwed into this drilled hole in such a manner that the seal 15 is pressed by the pressure disc 35 hard against the base of the drilled hole. Then the guide pin 11 is pushed through the Teflon sleeve 17 in the pressure screw 16, whereupon the terminal zone of the first cannula tube 3, which is welded centrally in the guide pin 11, passes through the central hole in the pressure disc 35 and the silicone seal 15 and opens into the passage 36 located below.

It is now possible directly to autoclave the arrangement assembled to this point, for example at about 121° C. in steam, in a suitable device. This is a particular advantage with a view to the isolation and purification of all types of biological cell systems. In order to ensure satisfactory sterilisation, introduction and removal of samples, the interiors of the centrifuge tubes 1, 1' are connected to the surrounding atmosphere by ventilation bores in the basic rotor body 4, which are not represented. An example of the course of a bore of this type is indicated in FIG. 4 by the broken line a.

After the autoclaving process, the arrangement which has been assembled in the manner described is placed, with the lid 10 open, onto the flange 27 and the terminal zone 29 of the drive shaft 5 in a rotation-resistant manner. To close the housing, the guide pin 11 is passed through the locking socket 14 of the lid 10 and the securing screw 13. The lid 10 is then placed in the annular recesses 23 of the housing ring 21. Finally, the securing screw 13 is screwed into the locking socket 14.

The process which has already been described in connection with FIGS. 1 to 3 can now be carried out.

Figure 5:
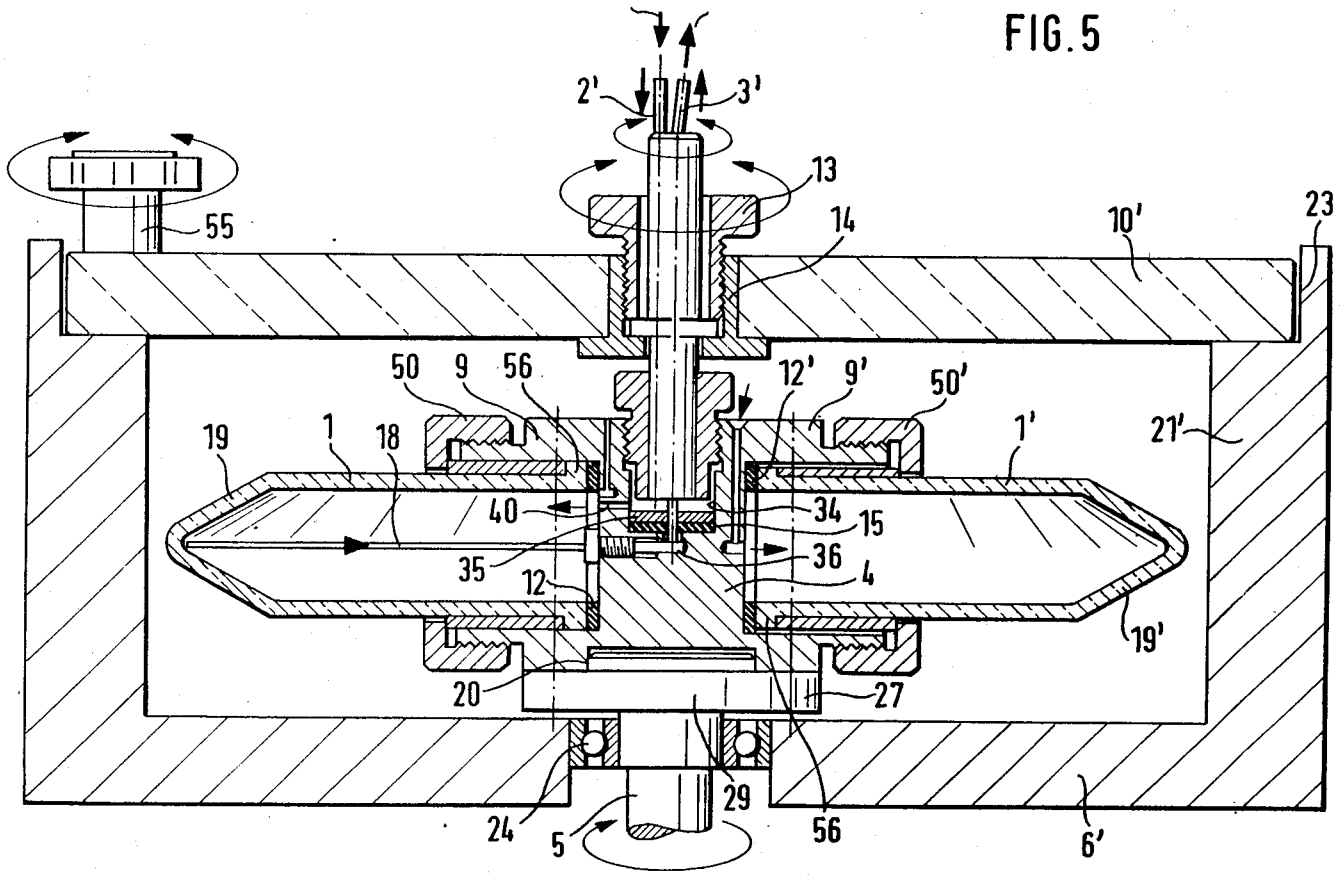
FIG. 5 shows a modification of the apparatus.

As can be seen in FIG. 5, it is also possible to fix the centrifuge tubes 1 and 1' to the basic rotor body 4 by means of union rings 50 and 50'. This entails that the union ring 50 or 50', which has been drawn over the centrifuge container 1 or 1', is screwed onto the basic rotor body 4, in particular onto the centering support ring 9 or 9'. The union ring 50 or 50' engages with a flange 8 or 8' of the centrifuge container 1 or 1' and presses the latter against the seal 12 or 12'. An adaptor sleeve 51 or 51', which is provided between the flange 56 or 56' of the centrifuge container and the union ring 50 or 50' and which transmits the bearing pressure from the union ring 50 or 50' to the flange 56 or 56' and the seal 12 or 12' ensures that the centrifuge container 1 or 1', which is centered in the centering support ring 9 or 9', is pressed in a completely leak-tight manner because, as a result of the decoupling by the adaptor sleeve 51 or 51', only axial forces and no shear forces are transmitted.

FIG. 5 shows that the housing ring 21' and the base flange 6' can also be made of one piece. The lig 10' can be fixed to the housing by means of a bolt or a screw 55.

In place of the tube 20, another suitable heat exchanger can also be provided as a heating arrangement.

It is possible to provide on the housing a switch (not represented) which interrupts the energising circuit of the motor when the lid 10, 10' is open. It is possible in this manner to prevent an operative unintentionally switching on the motor and setting the present apparatus in operation when the lid 10, 10' is open.

I claim:

1. Apparatus for producing liquid density gradients from particles, biological cell systems, colloids and the like, comprising a variable-speed rotor, a substantially horizontal centrifuge container mounted on and rotatable by said rotor, said container having an end portion remote from the axis of said rotor, and a cannula disposed in said container and having an intake end adjacent said axis and a discharge end adjacent said end portion, said rotor having a passage for admission into said intake end, at a first rotational speed of the rotor, of lighter and thereupon of heavier constituents of the liquid density gradients whereby the admitted constituents form in the container a plurality of bands containing lighter and heavier materials with the bands containing heavier materials disposed at a greater distance from said axis than the bands containing lighter materials, such bands being formed while the container is rotated at a second speed and being withdrawable from the container by way of said cannula and said passage.

2. The apparatus of claim 1, further comprising a second cannula provided in said rotor and arranged to admit the constituents of liquid density gradients into said passage, and a third cannula provided in said rotor and arranged to admit into said container additional constituents of the liquid density gradients by way of a second passage in said rotor.

3. The apparatus of claim 2, wherein said rotor, said container and said cannulae together constitute a unit which can be sterilized in an autoclave.

4. The apparatus of claim 1, wherein said rotor has a substantially vertical axis and a second passage communicating with the interior of said container, and further comprising a drive shaft connected with said rotor, means for rotatably holding said container on said rotor, second and third cannulae arranged to admit constituents of the liquid density gradients into said first named and said second passage, respectively, and means for non-rotatably connecting said second and third cannulae to said rotor.

5. The apparatus of claim 1, further comprising a drive shaft for said rotor, said rotor having an axially extending socket and said shaft having a stub extending into said socket, said shaft and said rotor further having flanges which are non-rotatably connected to each other.

6. The apparatus of claim 1, wherein said rotor comprises a centering support for said container and said container has a second end portion adjacent said support, and further comprising a seal between said support and the second end of said container and means for pressing said second end portion against said seal.

7. The apparatus of claim 6, wherein said support is threaded and said pressing means comprises a threaded union ring which mates with said support, said second end portion having a flange and further comprising adaptor means interposed between said flange and said union ring.

8. The apparatus of claim 1, further comprising holding means surrounding said container and having a flange adjacent said rotor, and a support which separably connects said flange to said rotor, said flange and said support constituting a bayonet mount.

9. The apparatus of claim 1, further comprising a seal provided in said rotor and surrounding the intake end of said cannula.

10. The apparatus of claim 1, wherein the end portion of said container defines a tip and the discharge end of said cannula is closely adjacent said tip.

11. The apparatus of claim 1, further comprising a counterweight provided on said rotor diametrically opposite said container, said counterweight being a substantial mirror image of said container and further comprising means for separably connecting said container and said counterweight to said rotor.

12. The apparatus of claim 1, further comprising a second cannula for admitting constituents of the liquid density gradients into said passage, a third cannula for admitting additional constituents into said container by way of a second passage in said rotor, and means for rotably connecting said second and third cannulae to said rotor including a guide pin installed in said rotor and means for locking said pin to said rotor.

13. The apparatus of claim 12, further comprising a housing for said rotor and said container, said housing having a lid and means for securing said pin to said lid.

14. The apparatus of claim 1, wherein said rotor has a chamber and further comprising a seal in said chamber, means for pressing said seal against the rotor, a second cannula arranged to admit constituents of the liquid density gradients into said passage, said second cannula extending through said pressing means and said seal, and a third cannula arranged to admit additional constituents into said chamber, said rotor having a second passage arranged to convey constituents from said chamber into said container.

15. The apparatus of claim 1, further comprising a housing for said rotor and said container, and a heat exchanger mounted on said housing and arranged to influence the temperature in said housing.

* * * * *